United States Patent [19]

Boeckmann

[11] Patent Number: 4,716,706

[45] Date of Patent: Jan. 5, 1988

[54] BAG FOLDING AND PACKAGING APPARATUS

[75] Inventor: Hugo Boeckmann, Arlington Heights, Ill.

[73] Assignee: Minigrip, Inc., Orangeburg, N.Y.

[21] Appl. No.: 898,877

[22] Filed: Aug. 21, 1986

Related U.S. Application Data

[63] Continuation of Ser. No. 552,157, Nov. 15, 1983, abandoned.

[51] Int. Cl.[4] ..... B65B 63/04

[52] U.S. Cl. ..... 53/117; 226/171; 493/204; 493/214; 493/414

[58] Field of Search ..... 53/116, 117, 429; 226/170, 171; 493/204, 214, 411–415

[56] References Cited

U.S. PATENT DOCUMENTS

| | | | |
|---|---|---|---|
| 2,604,687 | 7/1952 | Broden | 53/116 |
| 3,699,746 | 10/1972 | Titchenal et al. | 53/384 X |
| 3,707,063 | 12/1972 | McIntyre | 493/414 X |
| 3,735,554 | 5/1973 | Maggio | 493/415 X |
| 3,744,211 | 7/1973 | Titchenal et al. | 53/384 X |
| 4,279,610 | 7/1981 | Reba | 493/411 |
| 4,416,376 | 11/1983 | Scheffers et al. | 493/411 X |

FOREIGN PATENT DOCUMENTS

| | | | |
|---|---|---|---|
| 1170362 | 5/1964 | Fed. Rep. of Germany | 493/412 |
| 0156727 | 12/1979 | Japan | 493/414 |

*Primary Examiner*—Robert L. Spruill
*Assistant Examiner*—Steven P. Weihrouch
*Attorney, Agent, or Firm*—Hill, Van Santen, Steadman & Simpson

[57] ABSTRACT

A chain of plastic bags having zipper-locking profiles is compactly stacked in a rectangular carton in successive layers such that the bags of the chain lie flat in the carton and the zipper profile portions of successive bags in chain do not lie on top of one another by means of an automatic apparatus. The apparatus comprises an oscillating guideway for laterally depositing the bags of the chain in rows extending back and forth between opposed lateral sidewalls of the carton and a vertically movable lift table having a horizontally reciprocating platform on which the carton is disposed. The lift table operates to lower the carton beneath the guideway as the carton is being filled and to move the carton transversely of the guideway so that the zipper profiles of successive bag rows are disposed offset from one another.

3 Claims, 8 Drawing Figures

BAG FOLDING AND PACKAGING APPARATUS

CROSS-REFERENCE TO RELATED APPLICATION

This is a continuation of application Ser. No. 552,157, filed Nov. 15, 1983, now abandoned.

Cross-reference is made to a copending patent application of Richard W. Scheffers and Hugo Boeckmann for "Bag Package and Related Method", U.S. Ser. No. 431,449, which was filed on Sept. 30, 1982, and which issued as U.S. Pat. No. 4,416,376 on Nov. 22, 1983, and which is incorporated by reference in this application.

BACKGROUND OF THE INVENTION

The invention relates to an apparatus for stacking and accumulating a chain of interconnected flexible bags having cooperating zippers-locking fastener profiles in a folded condition in a rectangular carton, and, more particularly, to an automated machine for stacking and accumulating a chain of flexible bags of the type having zipper-locking profiles in a continuous manner which prevents the chain from being broken and enables the stack to be formed of a series of laterally directed back and forth layers resulting in substantial increase in the quantity of bag chain stacked in a carton.

As shown in U.S. Pat. Nos. 3,699,746 and 3,744,211, it is known for plastic bags, as formed of plastic film in a rectangular shape having an upper edge, a lower edge, and opposite lateral edges with zipper-locking profiles running laterally along each bag near its upper edge, to be connected one after another at a trailing lateral edge of one and a leading lateral edge of another so as to form a chain of such bags. It is known for a chain of plastic bags without zipper-locking profiles to be stacked vertically one directly on top of the other, such as disclosed in U.S. Pat. Nos. 4,201,029 and 3,699,746.

Because zipper-locking profiles are considerably thicker than other portions of such bags, and because such profiles tend to lie upon each other, a vertical stack of such bags having such profiles tends to be unstable and to require excessive space to accommodate such a stacking arrangement of these bags.

The present invention concerns a better way to package a chain of bags of plastic or other flexible material in a rectangular carton, wherein the bags are formed of plastic film in a rectangular shape having an upper edge, a lower edge, and opposite lateral edges with zipper-locking profiles running laterally along each bag near its upper edge to form a reclosable mouth opening. The present invention also concerns an automated apparatus for mechanically stacking and accumulating an indefinite length chain of such zipper-locking fastener profile flexible bags in this better way, so that the stacking process can be performed quickly and efficiently.

SUMMARY OF THE INVENTION

In accordance with the present invention, there is provided a conveyor assembly for laterally conducting a chain of interconnected flexible bags having zipper-locking profiles to a downstream end at which the bag chain passes vertically downward through an oscillating guideway means. The guideway means overlies and extends into an accumulation box, such as a rectangular carton which is disposed for back and forth horizontal movement transversely of the conveying direction of the bag chain and vertical reciprocation on a support table means.

By virtue of the oscillating movement of the guideway means and the relative horizontal and vertical movement of the carton, the bags in the chain are deposited for stacking in the carton in a series of vertical layers formed by continuous laterally extending rows of bags such that the zipper profiles of the bags in each layer do not lie on top of one another. This arrangement permits a substantial increase in the quantity of plastic bags which can be stacked in the carton.

The novel apparatus of this invention may be operated so as to produce the bag package described and claimed in the copending application incorporated by reference in this application.

Further objects, features, and advantages of the present invention will be evident from the following description of a preferred embodiment of this invention.

DESCRIPTION OF THE PREFERRED EMBODIMENT

Figure 1:
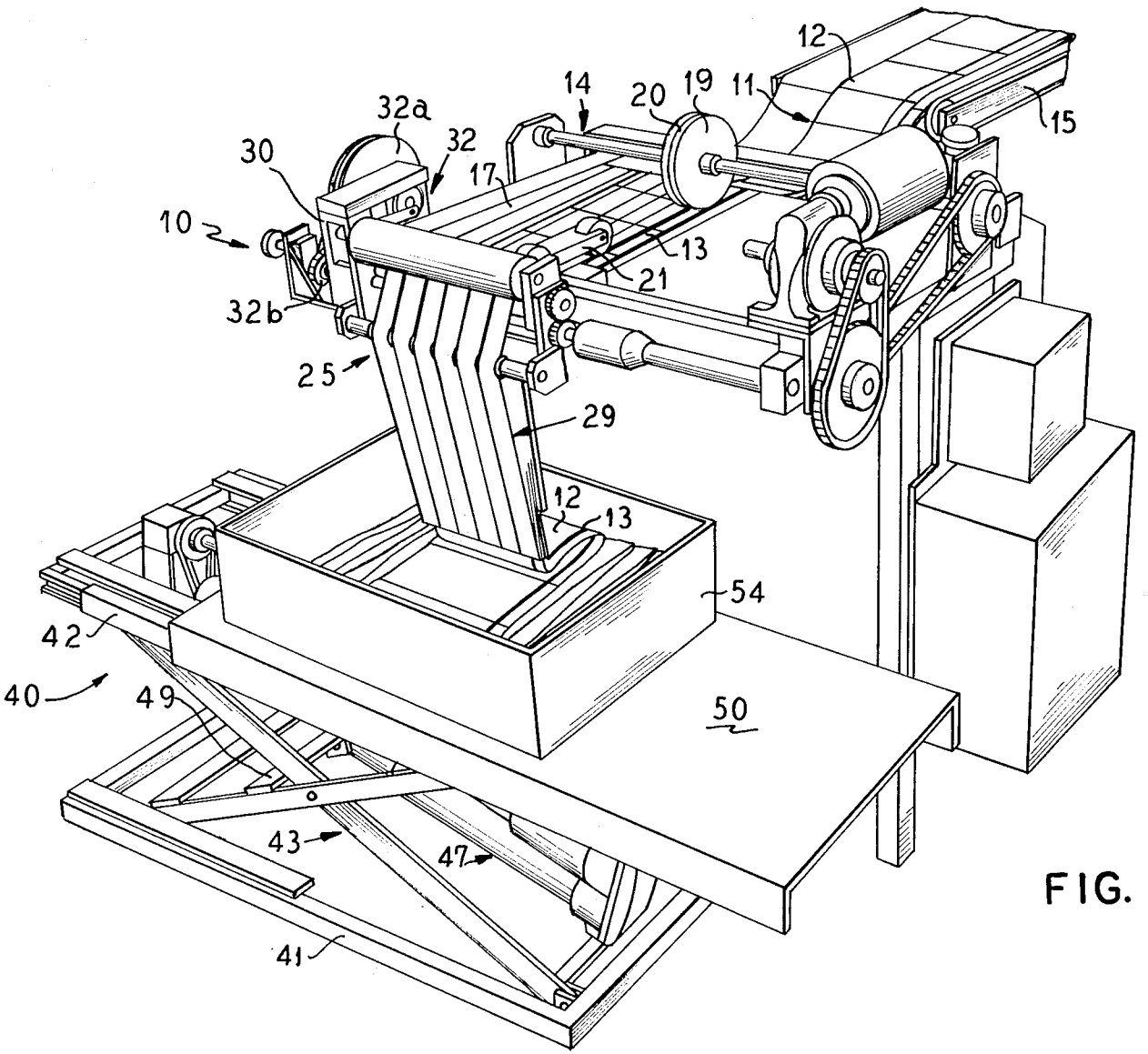
FIG. 1 is a perspective view of the automated bag chain stacking assembly constructed in accordance with the present invention.
Figure 2:
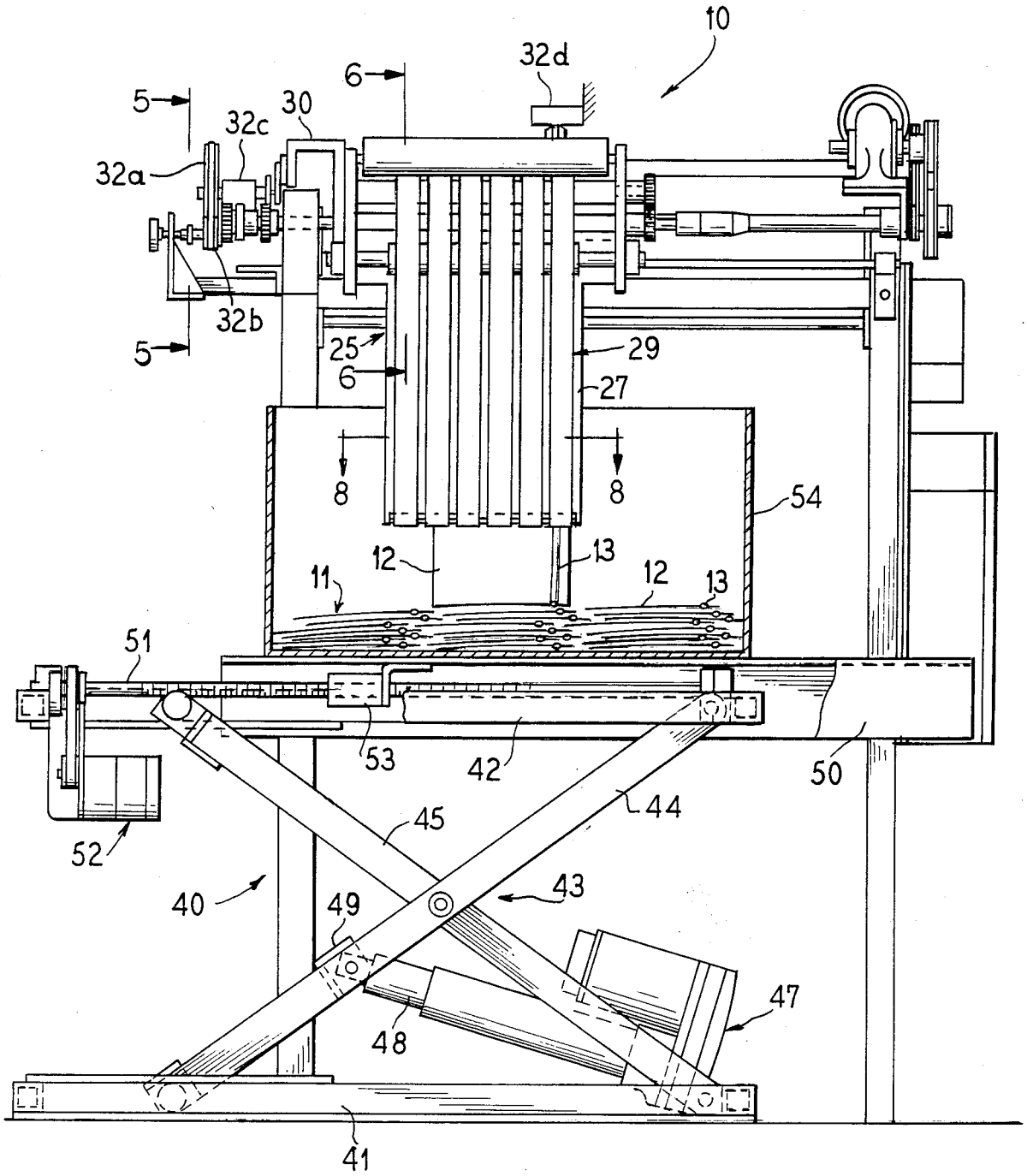
FIG. 2 is a front side elevational view of the bag chain stacking assembly of FIG. 1.

FIG. 1 illustrates an automated stacking assembly 10 for mechanically stacking and accumulating an elongated chain 11 of individual plastic bags 12 for packaging. Each individual plastic bag 12 is formed of plastic film in a rectangular shape having an upper edge, a lower edge, and opposite lateral edges with zipper-locking fastener profiles 13 extending laterally along each bag near its upper edge to form a reclosable mouth opening into the bag. The bags 12 are laterally connected one after another at a trailing lateral edge of one and a leading lateral edge of another so as to form the bag chain 11. Further details of such a chain are described in the copending application incorporated by reference in this application.

Figure 3:
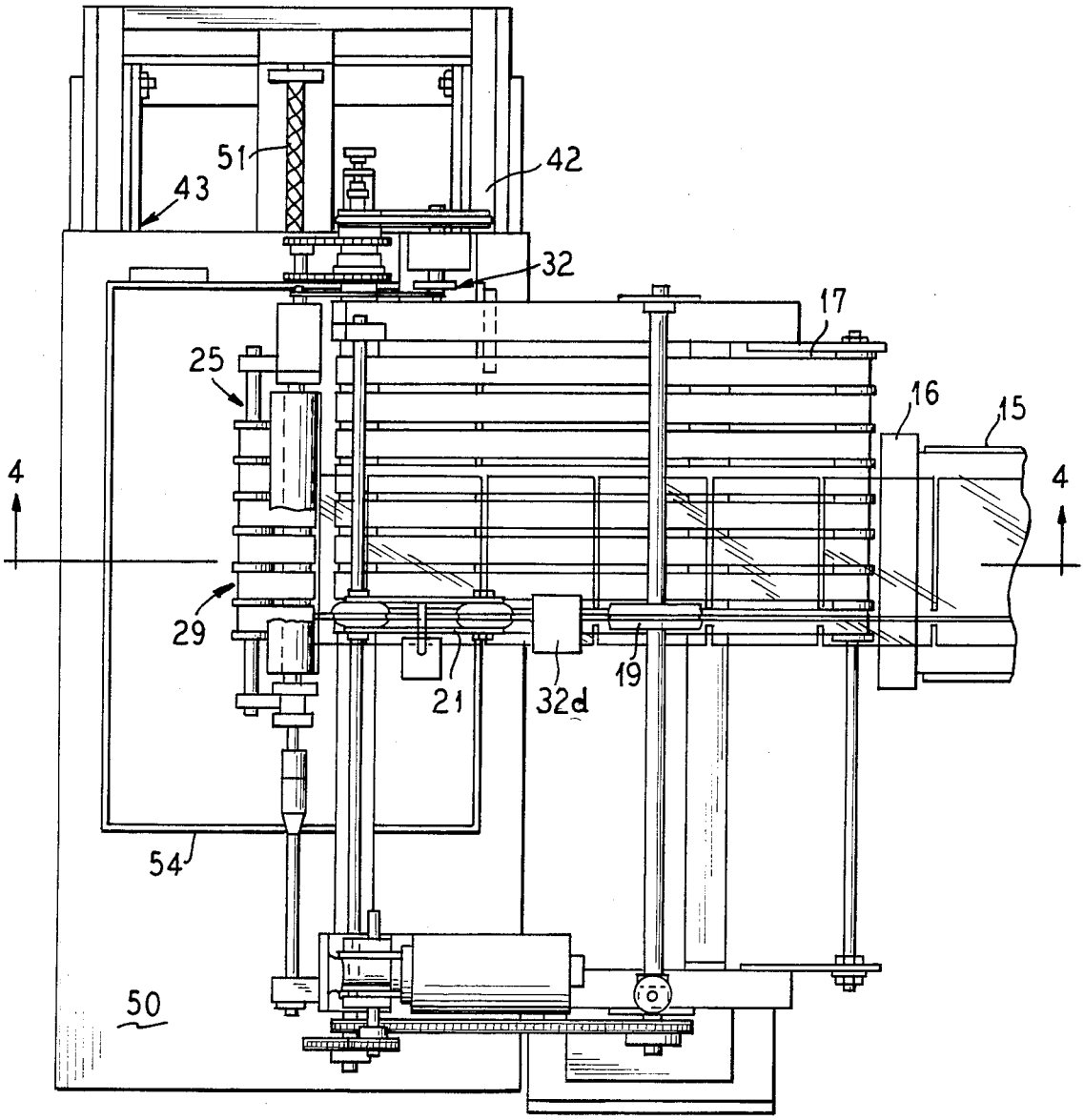
FIG. 3 is a partial plan view of the bag chain stacking assembly of FIG. 1.
Figure 4:
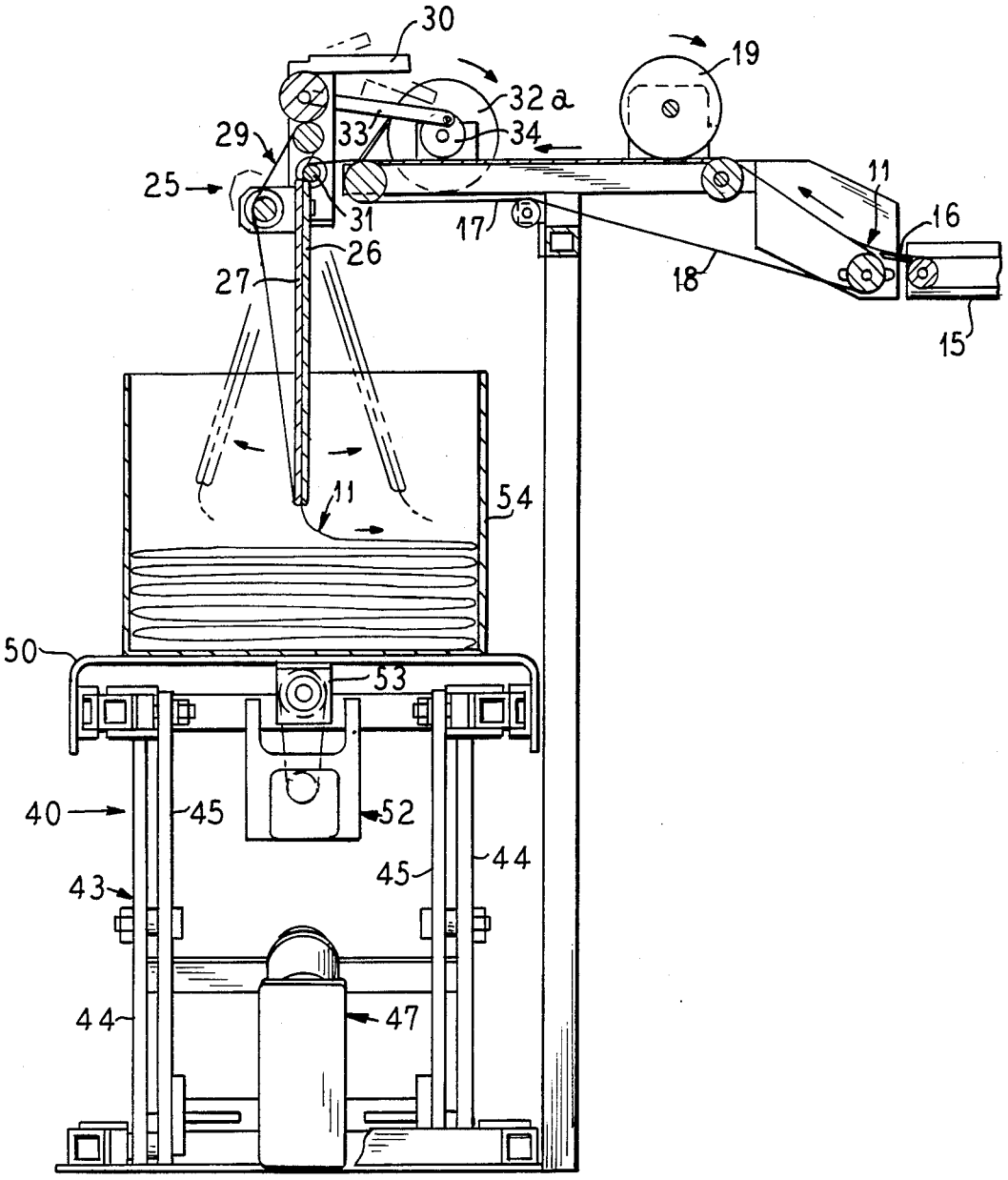
FIG. 4 is a cross-sectional, side elevational view taken along the lines 4—4 of FIG. 3.
Figure 5:
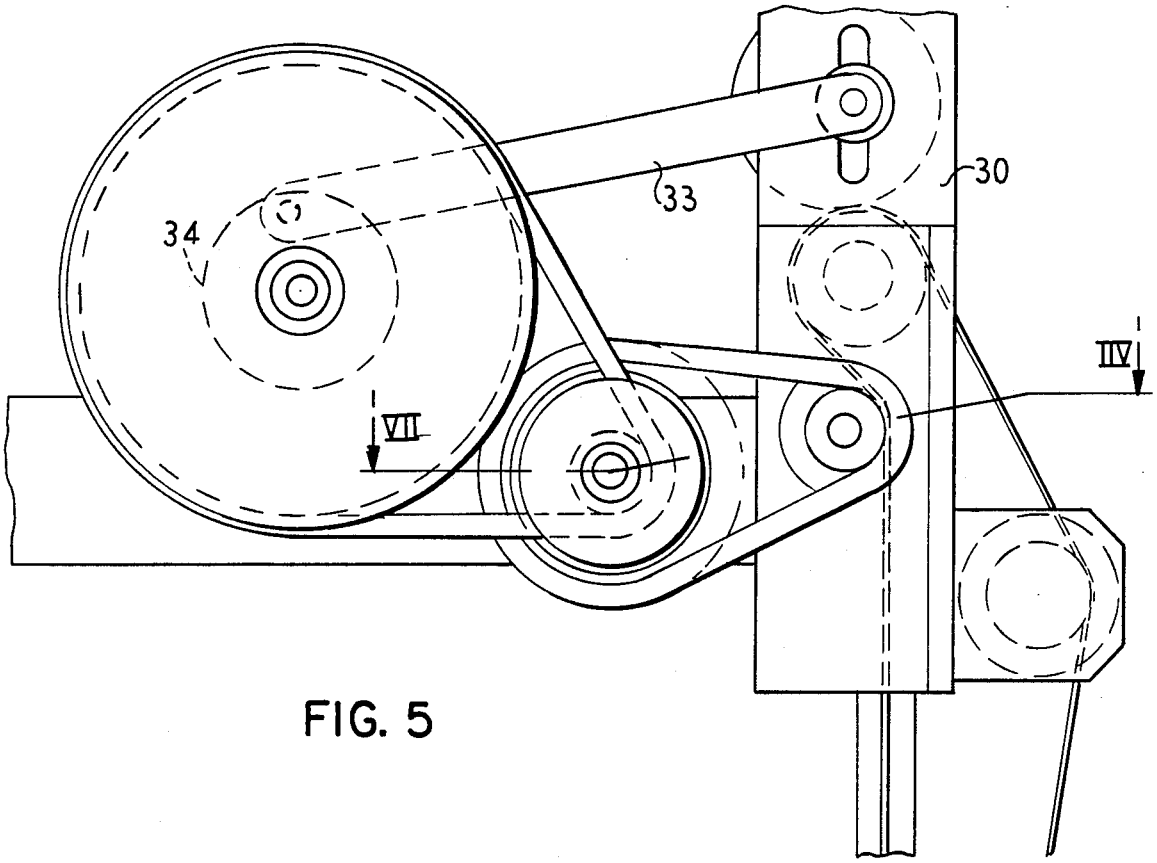
FIG. 5 is a fragmentary, cross-sectional side elevational view taken along the lines 5—5 of FIG. 2.
Figure 6:
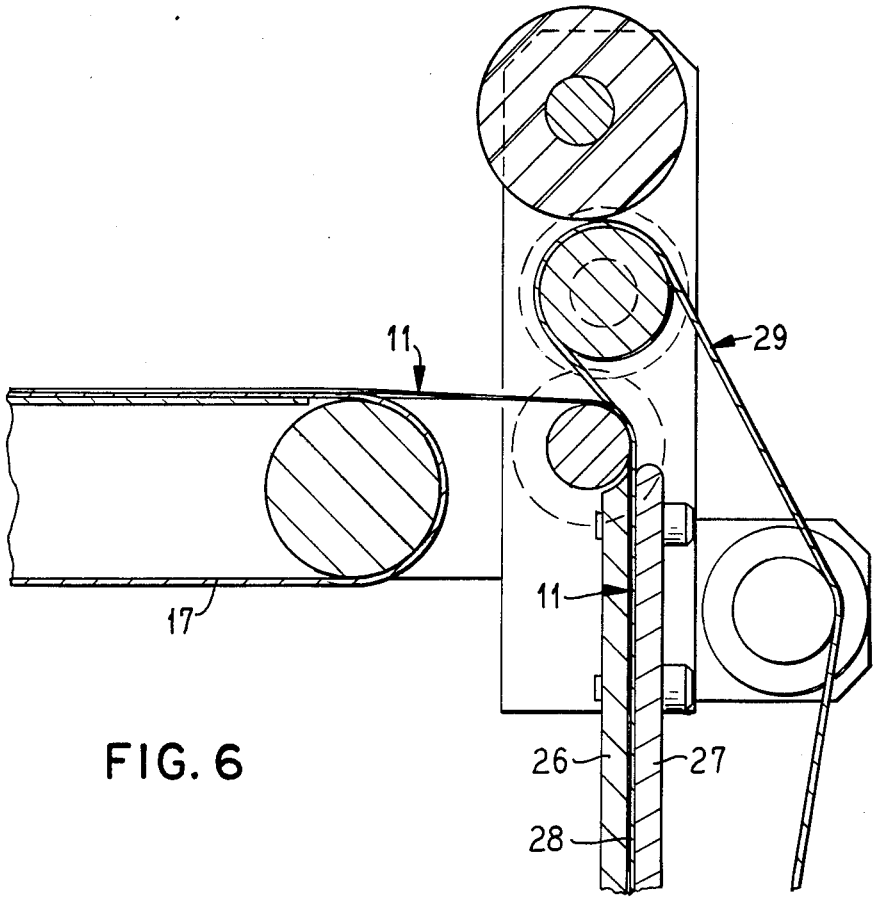
FIG. 6 is a fragmentary, cross-sectional side elevational view taken along the lines 6—6 of FIG. 2.
Figure 7:
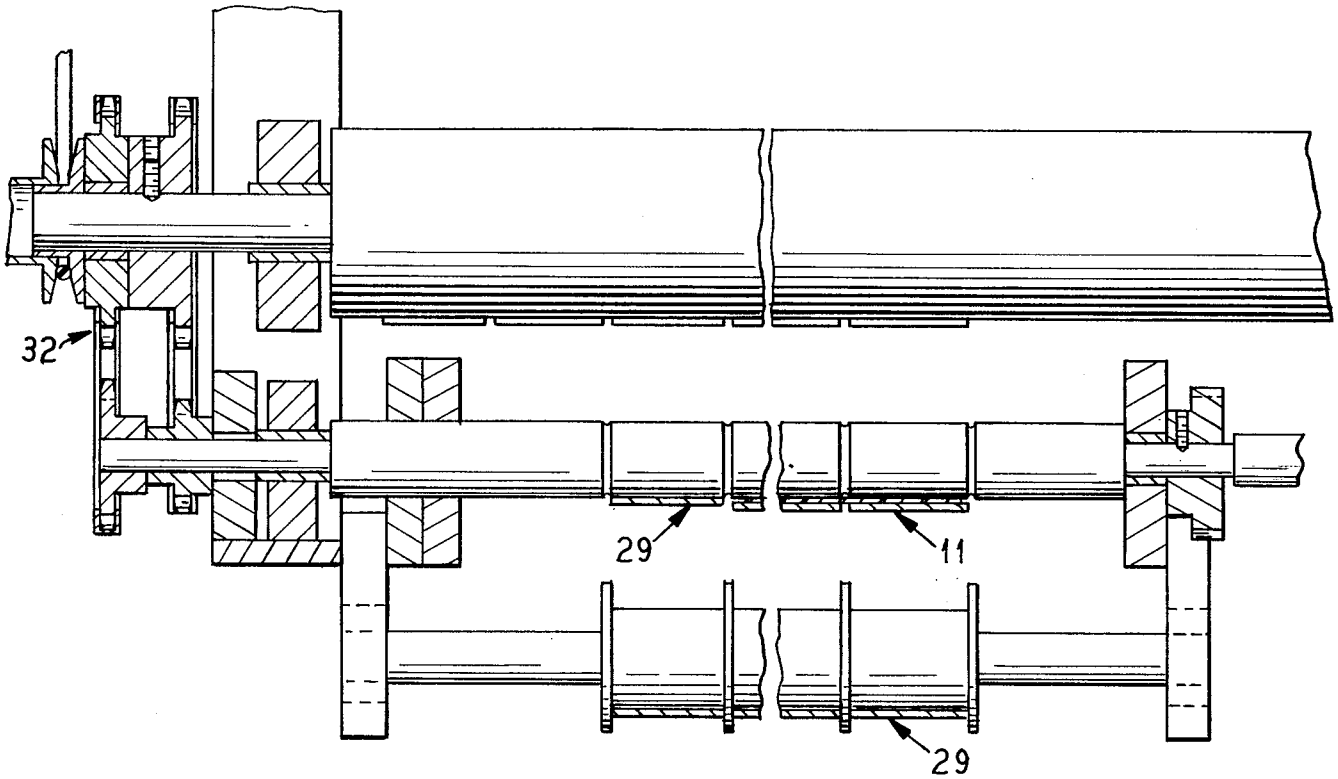
FIG. 7 is a fragmentary, cross-sectional plan elevational view taken along the lines 7—7 of FIG. 5.

With reference to FIGS. 1, 3, and 4, the automated assembly 10 comprises a bag chain conveyor means 14 for laterally conducting the bag chain 11 to a downstream deposit end thereof. The conveyor means 14 comprises a laterally running belt conveyor 15 which feeds the bag chain onto a guide plate 16 from which the bag chain is conveyed to the downstream end of the conveyor means 14 via a further belt conveyor 17. The belt conveyor 17 is formed by a series of laterally extending endless belts 18 threaded about suitably driven rollers and supporting the bag chain 11 from underneath for conveyance to the downstream end of the conveyor means. The belt conveyor 17 conveys the bag chain 11 beneath a suitably driven alignment roller 19 formed with a circumferential groove 20. The groove 20 of the roller 19 serves to receive the relatively thickened, zipper-profile portions 13 of the individual bags 12 for maintaining the predetermined alignment of the bag chain as it is conducted to the downstream end of the conveyor means 14. Adjacent the downstream end of the belt conveyor 17 and following the alignment roller 19 is a free-wheeling pressure roller device 21 having a pair of grooved rollers beneath which the fastener profiles 13 of the bags 12 must pass. The rolls of the pressure roller device 21 serve to further insure proper alignment of the bag chain 11 and also serve to press down on the cooperating fastener members of the zipper profiles 13 to assure that the zipper profiles are in their interlocked condition.

As shown in FIGS. 1 and 4–7, the bag chain 11 is directed vertically downward from the downstream end of the conveyor means 14 at the end of the belt conveyor 17 via a rocking guideway means 25. The oscillating guideway means 25 comprises an opposed pair of vertically downwardly directed plates 26 and 27 held together so as to be substantially parallel with one another, but defining therebetween a guideway space 28 through which the bag chain 11 passes. Running along the interior facing surface of the guide plate 27 so as to be in the guideway space 28 and threaded about suitably driven rollers is a series of axially directed endless belts forming a discharge conveyor means 29 for conducting the bag chain 11 through the guideway space 28 and out through the downstream, discharge end thereof. The vertically directed plates 26 and 27 and the discharge conveyor means 29 are supported on a mounting bracket 30 disposed adjacent the discharge end of the chain conveyor means 14 and adapted for continuous oscillating movement about a pivot shaft 31, the linear axis of which is horizontally transverse to the conveying direction of the bag chain 11. A suitable oscillating drive mechanism 32 such as illustrated here in the form of a crank shaft device being driven by adjustable pulleys **32*a*, 32*b*, via a solenoid-actuated clutch 32*c*, and having a crank arm 33 connected at one end to the mounting bracket 30 and at its other end to a rotary crank shaft 34 driven in time to sequence with the belt conveyor 17 via a drive belt connected to the driven roller for that conveyor, serves to continuously oscillate the mounting bracket 30, and hence the discharge guideway 26–28, laterally back and forth about the pivot shaft 31**.

The clutch **32*c* is controlled so as to respond to a signal from a proximity switch 32*d* (shown diagrammatically) which is arranged to send a signal releasing the clutch 32*c* whenever intervals or links between successive bags are sensed by the proximity switch. A mechanical finger (not shown) associated with the proximity switch 32*d*** may be used to sense intervals or links between successive bags. Thus, registration of the bags in the carton is obtained, despite minor deviations in bag widths.

Figure 8:
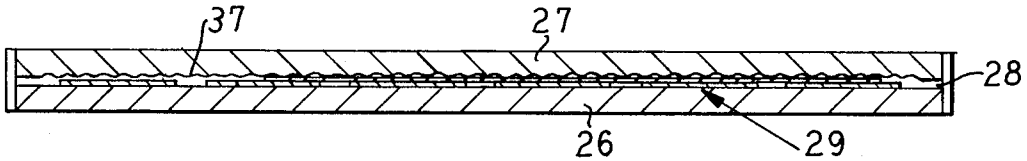
FIG. 8 is a fragmentary, cross-sectional plan elevational view taken along the lines 8—8 of FIG. 2.

As shown in FIG. 8, the interior facing surface of the guideway plate 26 is smooth for passage of the individual discharge conveyor belts therealong through the guideway space 28. However, the interior facing surface of the opposed plate 27 is slightly grooved to provide a series of sharp ridges and valleys 37 against which the bag chain 11 bears during movement thereof through the discharge guideway space 28. The serrated surface 37 of the plate 27 produces the frictional resistance against lateral movement of the bag chain 11 to facilitate passage of the bag chain through the guideway means.

As shown in FIGS. 1–4, the discharge free end of the guideway means plates 26 and 27 are directed downward toward a support table means 40 disposed adjacent the downstream end of the conveyor means 14. The support table means comprises a base frame 41 disposed on the floor and a movable platform frame 42 disposed above the base frame for up and down movement via a scissors-lift mechanism 43, which may be of a conventional construction. The scissors-lift mechanism 43 utilizes two sets of criss-cross arms 44 and 45 pinned together at a common pivot point 46. The arm ends on one side of the pivot 46 are pin connected to the upper and lower frames 41 and 42 and the arms ends on the other side of the pivot 46 are provided with rollers which translate along horizontal tracks formed in the upper and lower frames. A suitable drive means 47 is provided with a reciprocating plunger 48 connected at its free end with a laterally extending drive plate 49 connected at opposed ends thereof to counterpart arms 44 on each of the scissors arms sets 43 to raise and lower the scissors device and thus raise and lower the upper frame 42.

The upper frame 42 is in the form of the transversely horizontally directed track on which a table platform 50 is disposed for back and forth movement. This back and forth movement of the table platform 50 is brought about by a rotary cam screw 51 journaled at one end of the upper frame 42 and extending longitudinally of the upper frame. A suitable rotary drive means 52 is mounted on the upper frame 42 at one end thereof for turning the rotary cam screw 51 having double threads. A follower nut 53 is disposed for movement on the rotary cam screw 51 and this nut is secured to the bottom of the table platform 50, such that rotation of the cam screw 51 causes the table platform to translate back and forth on the upper frame 42 in the horizontal direction transverse to the conveying direction of the bag chain 11.

The table platform 50 is adapted to receive disposed thereon an accumulation box, such as a rectangular carton 54 in which the bag chain is to be stacked for packaging by virtue of deposit therein from the chain conveyor 14 and oscillating guideway means 25. The reciprocation stroke of the platform is defined by the distance between opposed carton endwalls.

Operation of the apparatus 10 is as follows. The indefinite length bag chain 11 is initially manually threaded along the chain conveyor assembly 14 and on into the guideway space 28 of the oscillating guideway means 25. The support table means 40 is disposed such that the upper frame 42 is in a relatively lowered position, such that the empty carton 54 is placed on the table platform underlying the vertically directed guideway plates 26 and 27 and such that the discharge free end of the guideway means 25 extends into the carton adjacent the bottom floor thereof.

The operation of the automatic apparatus 10 may be preset or adapted for uniform operation with a particular size carton to be filled with the bag chain. As those skilled in the art will appreciate, preset operation calls for the lateral oscillating movement of the guideway means 25 to be predetermined by the eccentricity of the crank arm 33 on the crankshaft 34 so as to produce a full back and forth laying of the bag chain between opposed side edges of the carton 54. Also, the carton 54 is positioned in a prearranged place on top of the table platform 50, such as may be indicated by markings on the platform. The table platform itself is disposed for movement back and forth between predetermined limits defined by the transverse length of the carton, such that the carton continuously moves back and forth beneath the overhanging guideway means 25 without any prolonged abutment against the lengthwise opposed side edges of the carton. The cam screw 51 has a double thread so as 52 to produce the back and forth movement of the platform 50.

Furthermore, the scissors arm drive 47 indexes the upper frame 42 downwardly in suitable response to activation of one or more limit switches (not shown) disposed on the upper frame and engaged by the table platform during its back and forth movement. Preferably the upper frame 42 thus is arranged to index downwardly by a predetermined distance after each full reciprocation of the table platform.

With the discharge end of the guideway means 25 thus disposed for depositing bag chain into the empty carton 54, the operator commences automatic operation of the apparatus 10 from a central control switch. As a result of back and forth oscillating movement of the guidway means 25 and the transverse indexing of the carton 54 on the support table means 40, the interconnected bags of the bag chain 11 are laid flat in the carton in a series of rows one behind the other and successive layers of such rows. In each layer of bag chain in the carton, the zipper-profile upper edges of the bags all face one longitudinal side wall of the carton and, in zig-zag fashion, the zipper profiles on the bags of each succeeding row in the layer are disposed spaced longitudinally apart from the zipper profiles of the bags in the previous lateral row. The oscillating movement of the guideway means 25 serves to extend each lateral row of bags in the bag chain fully between the opposed lateral sidewalls of the carton. The platform 50 is translated continuously in each stroke direction, but at a gradual enough speed that the guideway means 25 is able to lay substantially laterally directed rows of bags between the sidewalls of the carton albeit in a zig-zag fashion. Downward indexing of the lift table means 40 causes more successive layers of bag chain to be laid in like manner in the carton so that the bottom wall of the carton is substantially covered by these successive layers thus laid, as shown in FIG. 1. As a result of this manner of packaging a chain of plastic bags having zipper profiles in a carton, the zipper profiles of each row and succeeding layer tend not to be disposed on top of the zipper profiles of the bags of the previous layer, thus conserving packaging space within the carton and permitting a substantial increase in the number of fastener profile-type plastic bags which can be disposed in the carton.

Further details of such a carton filled with a bag chain in such a manner as results from operation of the apparatus 10 may be obtained from the copending application incorporated by reference in this application.

When the carton is suitably filled with the continuous bag chain deposited as a result of operation of the apparatus 10, the operator may stop the apparatus, engages the lift table means 40 to lower the carton out from under the vertically directed guideway means 25 for transfer of the filled carton to a station for further packaging, and replace the filled carton with an empty carton to once again resume the packaging operation of the apparatus 10.

The portion of the bag chain 11 to be contained within the carton 54 may be severed from the remainder of the bag chain still in the conveyor sections 14 and 25 of the apparatus 10 by manually separating the lateral edge connecting links between adjacent bags in the chain.

It is also contemplated that stop means may be employed, such as in the form of bag counters along the conveyor means 14 or a limit switch means for detecting when the upper frame 42 of the lift table means 40 has reached a predetermined lowered position during the carton filling operation, to shut off the apparatus 10.

Although various minor modifications may be suggested by those versed in the art, it should be understood there are to be embodied within the scope of the patent warranted hereon all such modifications as reasonably and properly come within the scope of this contribution to the art.

I claim:

1. An apparatus for stacking a chain of flexible bags in a rectangular carton having a bottom wall, an upstanding laterally opposed pair of sidewalls, and an upstanding longitudinally opposed pair of endwalls, in which each bag is formed in a rectangular shape having an upper edge, a lower edge, and opposite lateral edges with zipper-locking profiles running laterally along such bag near its upper edge to define a reclosable mouth and wherein said bags are connected in the chain one after another at a trailing lateral edge of one and a leading lateral edge of another, comprising, in combination:

a feed conveyor means for continuously laterally conducting said chain to a downstream end thereof, a discharge conveyor means for continuously receiving said chain from said feed conveyor means and passing said chain generally downward through a guideway, said guideway having a discharge end and being disposed for continuous back and forth pivotal movement by an oscillating means, said guideway comprising a pair of plates facing across a fixed space from one another, said chain passing along the face of one said plate formed with ridges such that said zipper-locking profiles are guided between adjacent ridges thereof, and said discharge conveyor means comprising movable belt means passing along the face of the other said plate, a vertically movable support table means having a platform on which said carton is disposed for back and forth reciprocation in the longitudinal direction of said carton underlying said guideway discharge end, a first drive means for raising and lowering said platform, and a second drive means for reciprocating said platform in continuous back and forth motion, whereby said carton is filled with said chain from said guideway discharge end without any prolonged filling against said carton endwalls, such that said bags are disposed in successive vertical layers of series of laterally directed rows of bags longitudinally offset from one another and the zipper-locking profiles of said bags do not lie directly on top of one another.

2. The apparatus of claim 1, wherein said feed conveyor means comprises means for maintaining alignment of the bags of said chain along a lateral flow path and interlocking the zipper profiles of each bag.

3. The apparatus of claim 1, wherein said guideway discharge end extends into said carton and said first drive means intermittently lowers said carton on said platform as said carton is being filled.

* * * * *